US009145004B2

(12) United States Patent
Tronçon et al.

(10) Patent No.: US 9,145,004 B2
(45) Date of Patent: Sep. 29, 2015

(54) INKJET PRINTING MACHINE WITH CALIBRATION BEZEL

(71) Applicant: MACHINES DUBUIT, Noisy le Grand (FR)

(72) Inventors: Daniel Tronçon, Noisy le Grand (FR); Rui Monteiro, Gagny (FR); Jean-Louis Dubuit, Paris (FR); Didier Trolio, Verdun (FR)

(73) Assignee: MACHINES DUBUIT, Noisy le Grand (FR)

( * ) Notice: Subject to any disclaimer, the term of this patent is extended or adjusted under 35 U.S.C. 154(b) by 0 days.

(21) Appl. No.: 14/058,745

(22) Filed: Oct. 21, 2013

(65) Prior Publication Data

US 2014/0111588 A1 Apr. 24, 2014

(30) Foreign Application Priority Data

Oct. 22, 2012 (FR) ..... 12 60039

(51) Int. Cl.

| | |
|---|---|
| ***B41J 2/01*** | (2006.01) |
| ***B41J 3/407*** | (2006.01) |
| ***B41J 3/54*** | (2006.01) |
| *B41J 11/00* | (2006.01) |

(52) U.S. Cl.

CPC ..... *B41J 3/4073* (2013.01); *B41J 3/543* (2013.01); *B41J 11/0015* (2013.01)

(58) Field of Classification Search

CPC ..... B41J 11/007; B41J 11/06; B41J 11/0085; B41J 13/103; B41J 11/0065

USPC ..... 347/104, 101, 107

See application file for complete search history.

(56) References Cited

U.S. PATENT DOCUMENTS

| | | | | |
|---|---|---|---|---|
| 2,696,392 | A * | 12/1954 | Case | 280/513 |
| 6,540,426 | B2 * | 4/2003 | Cloyd et al. | 403/122 |
| 2012/0098914 | A1 * | 4/2012 | Dubuit et al. | 347/104 |
| 2013/0220196 | A1 * | 8/2013 | Brand | 114/116 |

FOREIGN PATENT DOCUMENTS

EP 2 444 251 A1 4/2012

OTHER PUBLICATIONS

French Search Report for FR 12690039 dated Sep. 12, 2013.

* cited by examiner

*Primary Examiner* — Manish S Shah
*Assistant Examiner* — Yaovi Ameh
(74) *Attorney, Agent, or Firm* — Buchanan Ingersoll & Rooney P.C.

(57) ABSTRACT

A printing machine including a calibration bezel. The calibration bezel includes a central opening coaxial to the axis of rotation of the core such that an object to be printed passes through the central opening before being printed by the printing station. The calibration bezel includes moving elements movable between a tightened position in which the central opening is small, and a loose position in which the central opening is large, and means for moving the movable moving elements between the positions so that the calibration bezel is in the tightened position when an object is transferred from the transport means to the printing station at least until the central opening is crossed by one end of the object and in the loose position when an object is transferred from the transport means to the printing station.

9 Claims, 12 Drawing Sheets

INKJET PRINTING MACHINE WITH CALIBRATION BEZEL

Figure 1:
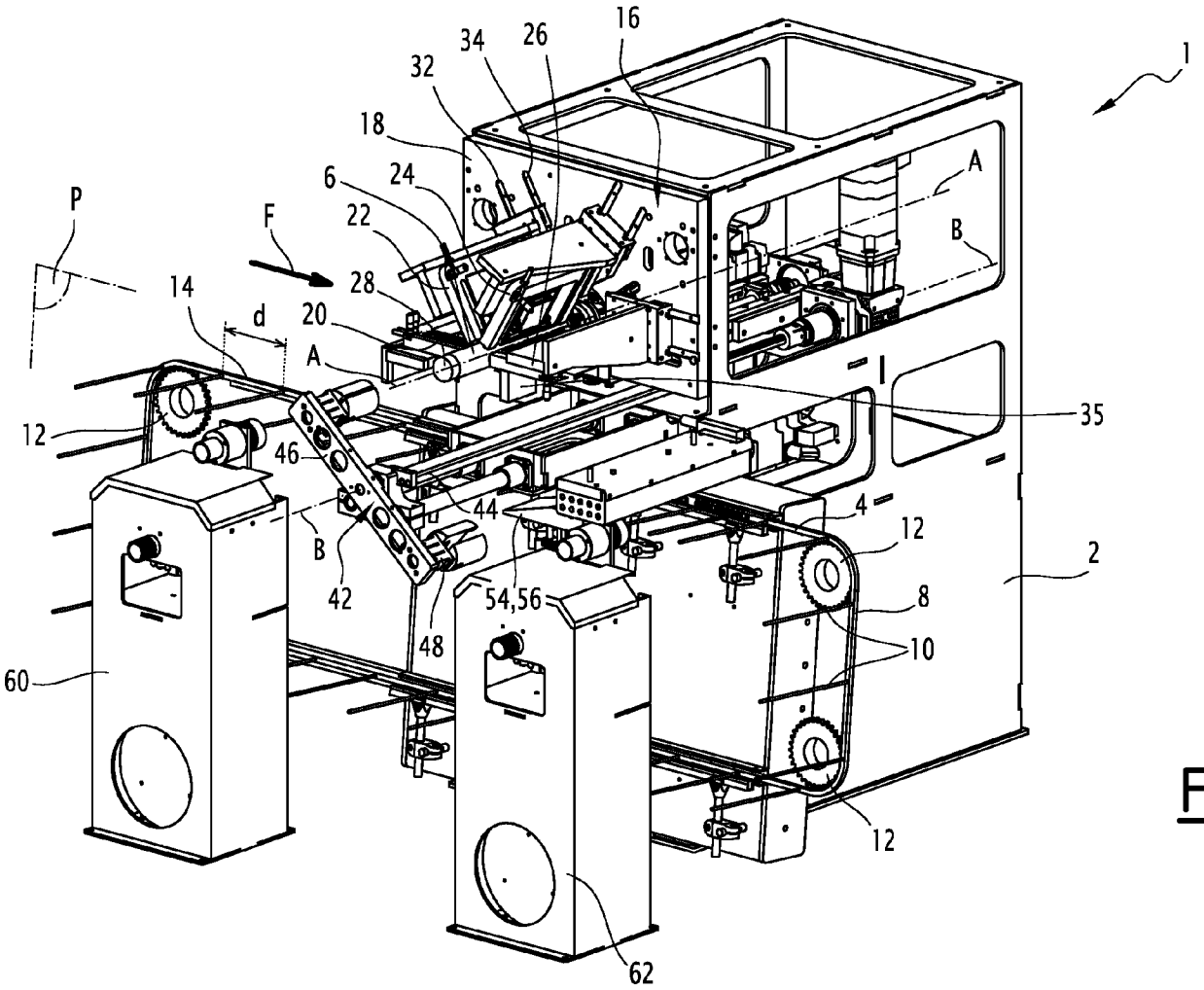

The present invention relates to a printing machine for objects with shapes substantially of revolution, said machine comprising:

- means for transporting objects to be printed between at least one loading station for loading the objects on said transport means and an unloading station for unloading said objects from said transport means,
- at least one printing station positioned between the loading station and the unloading station, said printing station comprising at least one printing unit arranged to spray ink on the objects to be printed so as to print said objects, the or each printing unit projecting ink of a different color so as to form a color print, the printing station comprising a corresponding core for holding an object to be printed, said corresponding core being rotatable around its axis such that the or each printing unit projects ink on the object held by said corresponding core,
- means for transferring an object to be printed from the transport means to the printing station and from the printing station to transport means, and
- a calibration bezel comprising a central opening coaxial to the axis of rotation of the core, said bezel being arranged between the transfer means and the printing units such that an object to be printed passes through the central opening before being printed by the printing station.

Application EP 2,244,251 describes an inkjet printing machine whereof the printing station includes a single core for holding an object to be printed, in particular a tube. Several printing units are positioned around the core to ensure multi-color printing of the object. Means for transferring an object to be printed are positioned between a conveyor and the printing station. They in particular see to the transfer of the object to be printed from the transport conveyor to the core.

In order to prevent an object with unsuitable dimensions from being placed on the core, a calibration bezel prohibiting the placement of an object with an excessive diameter is provided in front of the core on the loading side.

This calibration bezel operates in a satisfactory manner to prevent noncompliant objects from being introduced on the core, but that same bezel can cause scratching of the previously printed object during removal of the object when the ink has not yet dried. Such risks of scratching are very present, in particular when means exist for blowing air from the core over the inner surface of the object to make it easier to unload after printing. In fact, these air blowing means lead to a slight increase in the diameter of the object, which favors the placement of the object in contact with the calibration bezel upon removal from the tube.

The invention aims to offset this drawback of any scratching on the surface of the object after printing.

To that end, the invention relates to a printing machine of the aforementioned type, characterized in that the calibration bezel includes movable elements that can be moved between a tightened position of the bezel in which the central opening is small, and a loose position of the bezel in which the central opening is large, and means for moving the movable moving elements between the tightened and loose positions so that the calibration bezel is in the tightened position when an object is transferred, by the transfer means, from the transport means to the printing station at least until the central opening is crossed by one end of the object and in the loose position when an object is transferred, by the transfer means, from the transport means to the printing station.

According to other features of the printing machine, considered alone or according to any technically possible combinations:

- the diameter of the central opening in the tightened position of the calibration bezel is larger than the diameter of the core and arranged so that there is a space of at least 0.1 mm between object passed through the central opening of the bezel and the or each printing unit when the calibration bezel is in the tightened position;
- the bezel is movable and arranged to actuate a contactor, arranged to stop the transfer means when it is actuated, if an object to be printed having a diameter larger than the diameter of the central opening, withdrawn by the transfer means, moves said bezel;
- the core is translatable along its axis between a printing position, in which the free end part of the core is located across from the printing units, and a loading position, in which the central opening of the bezel surrounds the free end part of the core;
- the transfer means comprise at least one moving arm supporting gripping means for gripping an object to be printed, said arms and said gripping means being arranged to withdraw an object from the transport means and deposit said object on the core and to withdraw the printed object from said core and deposit that printed object on the transport means through the calibration bezel;
- in the tightened position of the calibration bezel, the diameter of the central opening is substantially equal to the outer diameter of the object increased by one times the distance separating the or each printing unit from the outer surface of the object;
- the movement means include a motor and a slide moved by the motor, said slide including at least one cam surface capable of cooperating with at least one complementary cam surface provided on at least one moving element to move the moving element in at least one direction under the action of the movement of the slide;
- the moving elements include at least two crown sectors, which inwardly substantially delimit a circle in the tightened position, said crown sectors being translatable relative to one another along at least one ray of the circle; and
- the movement means include at least one elastic return means for returning the or each moving element toward one of the tightened and loose positions.

Figure 2:
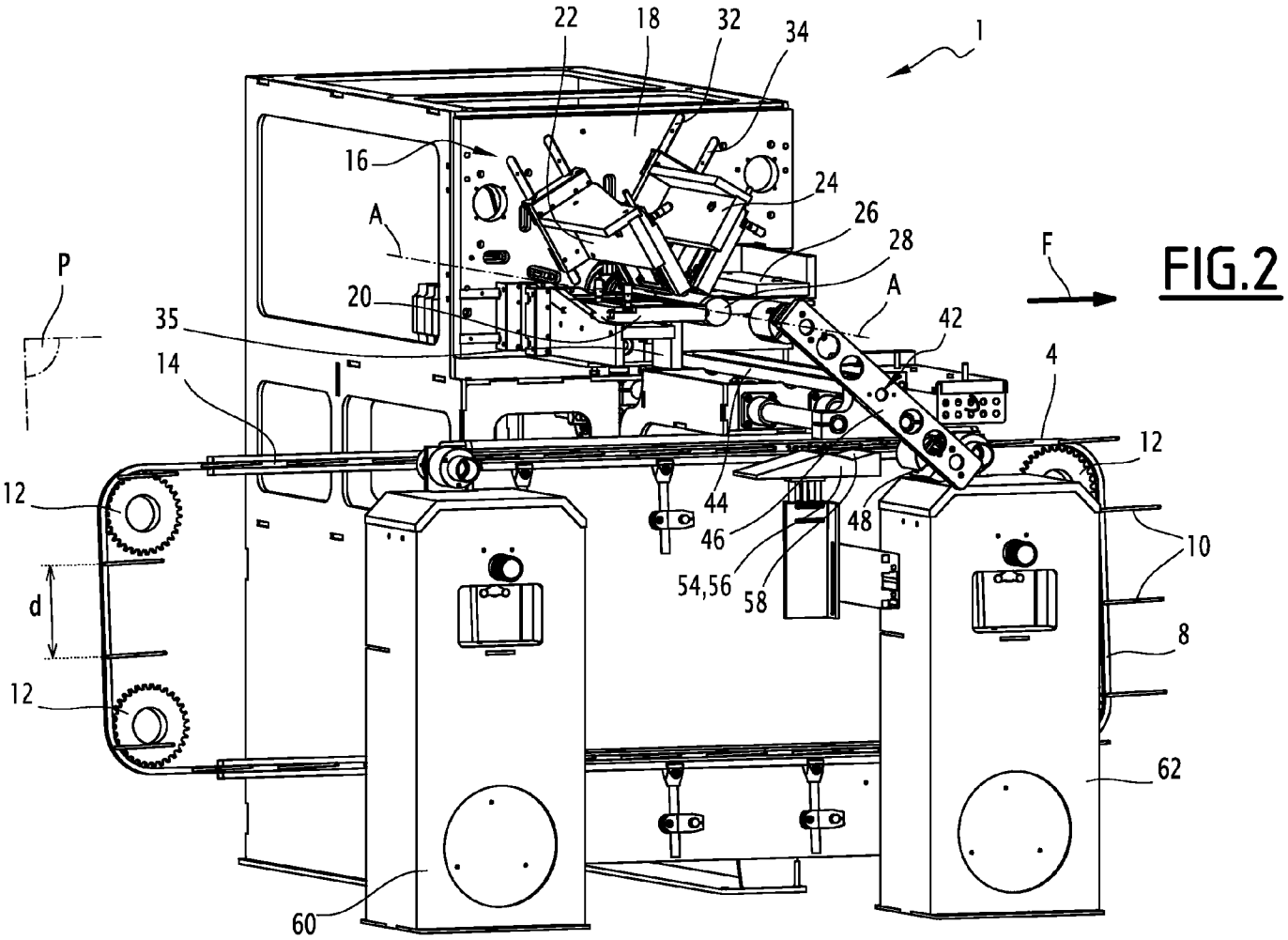
Figure 3:
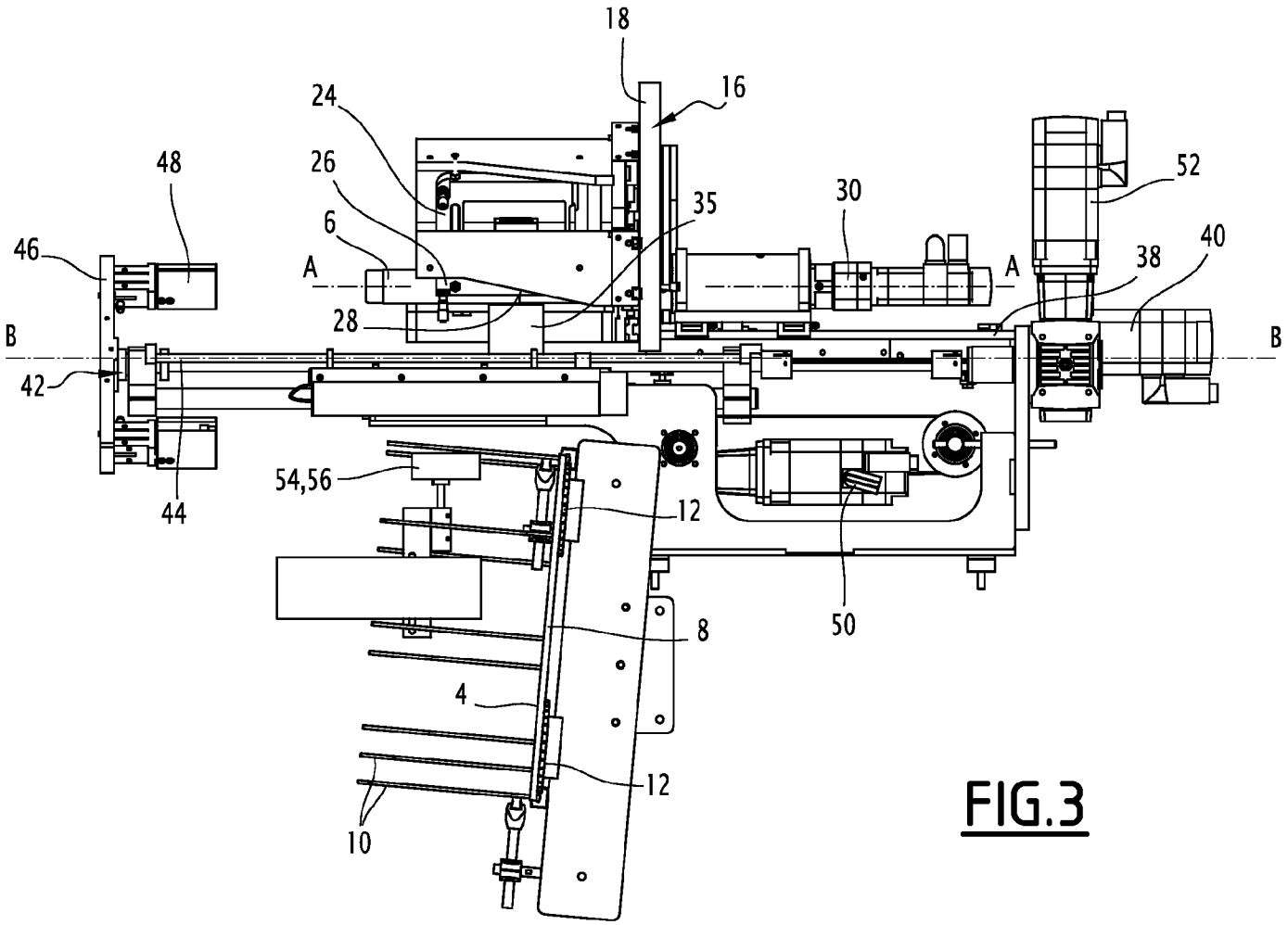
Figure 4:
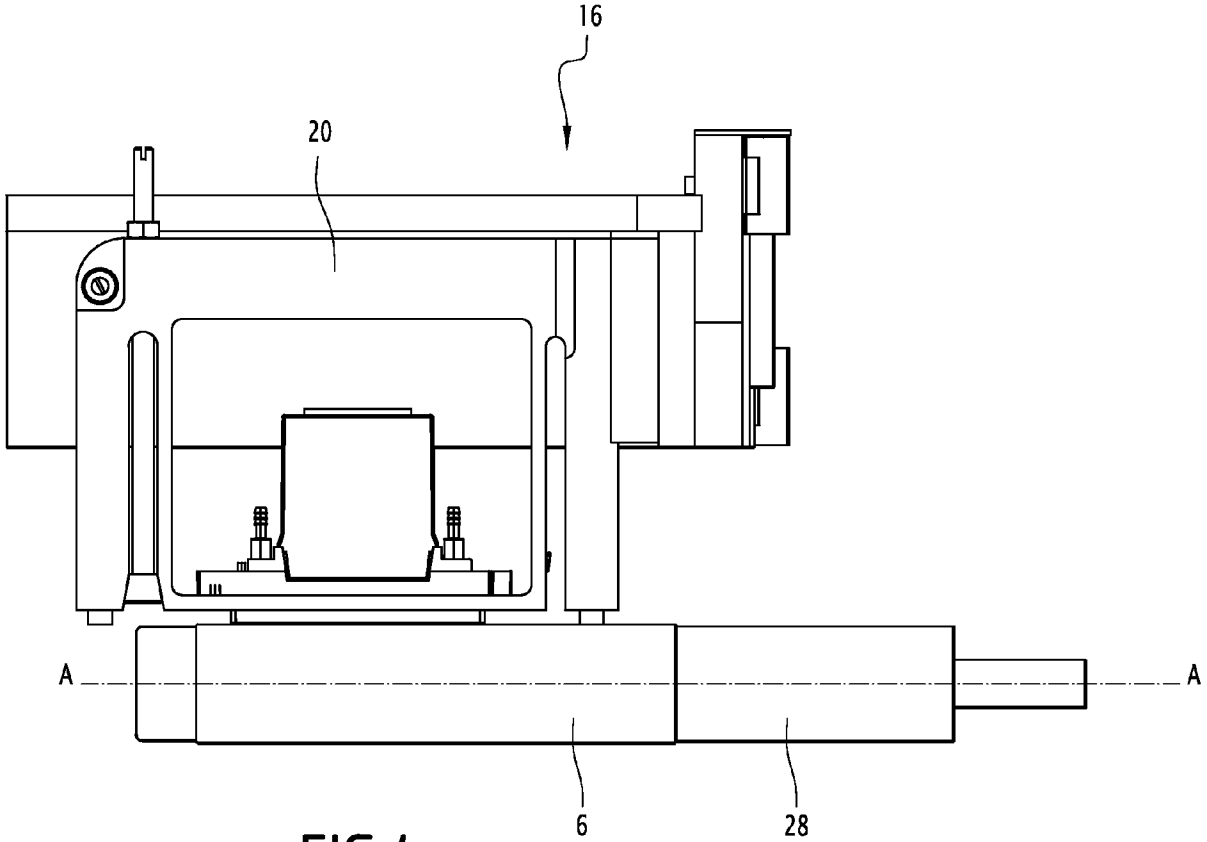
Figure 5:
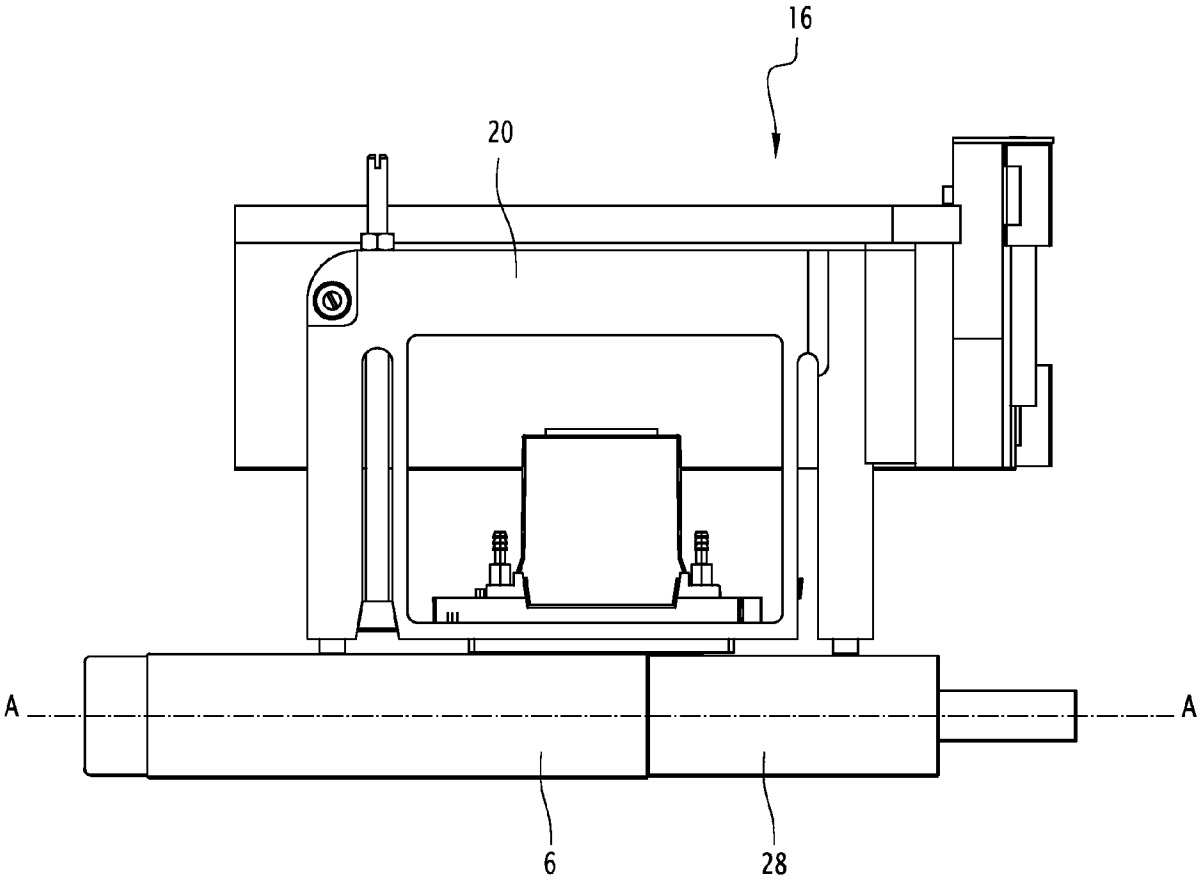
Figure 6:
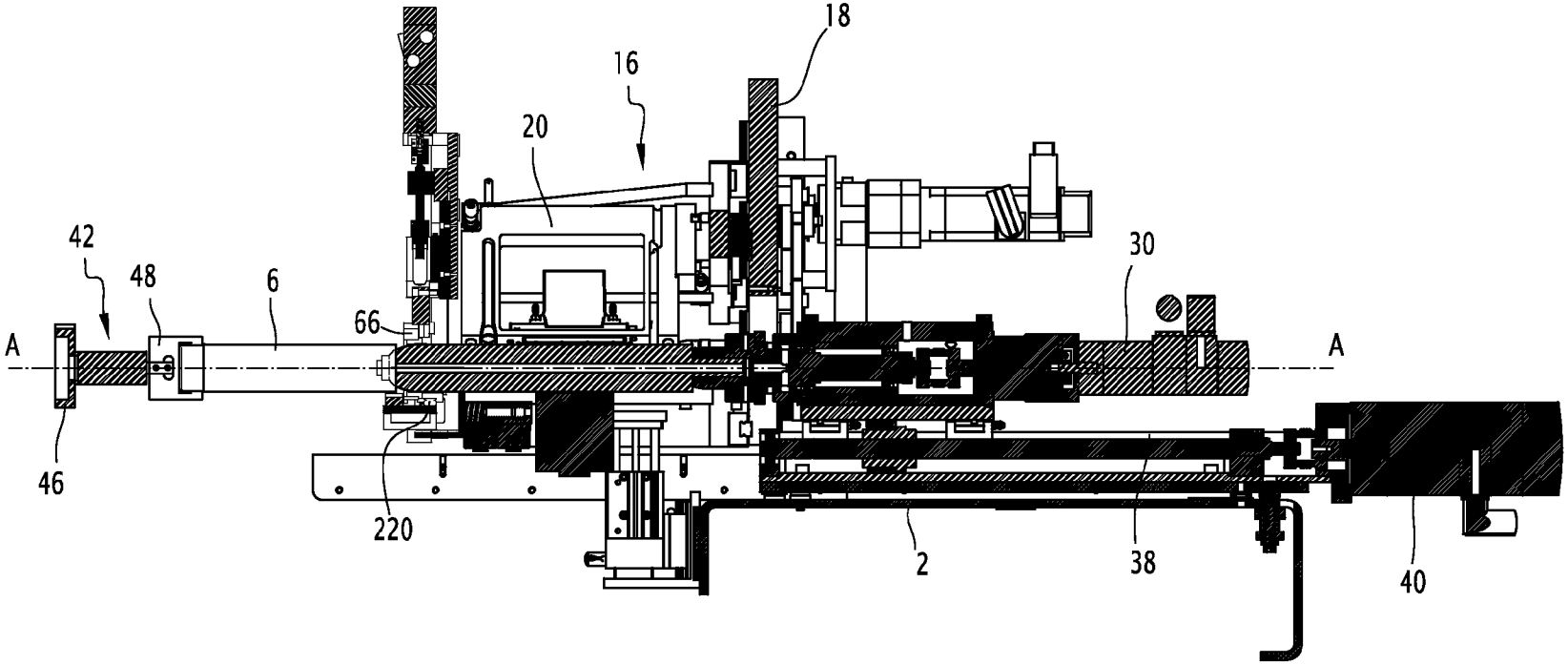
Figure 7:
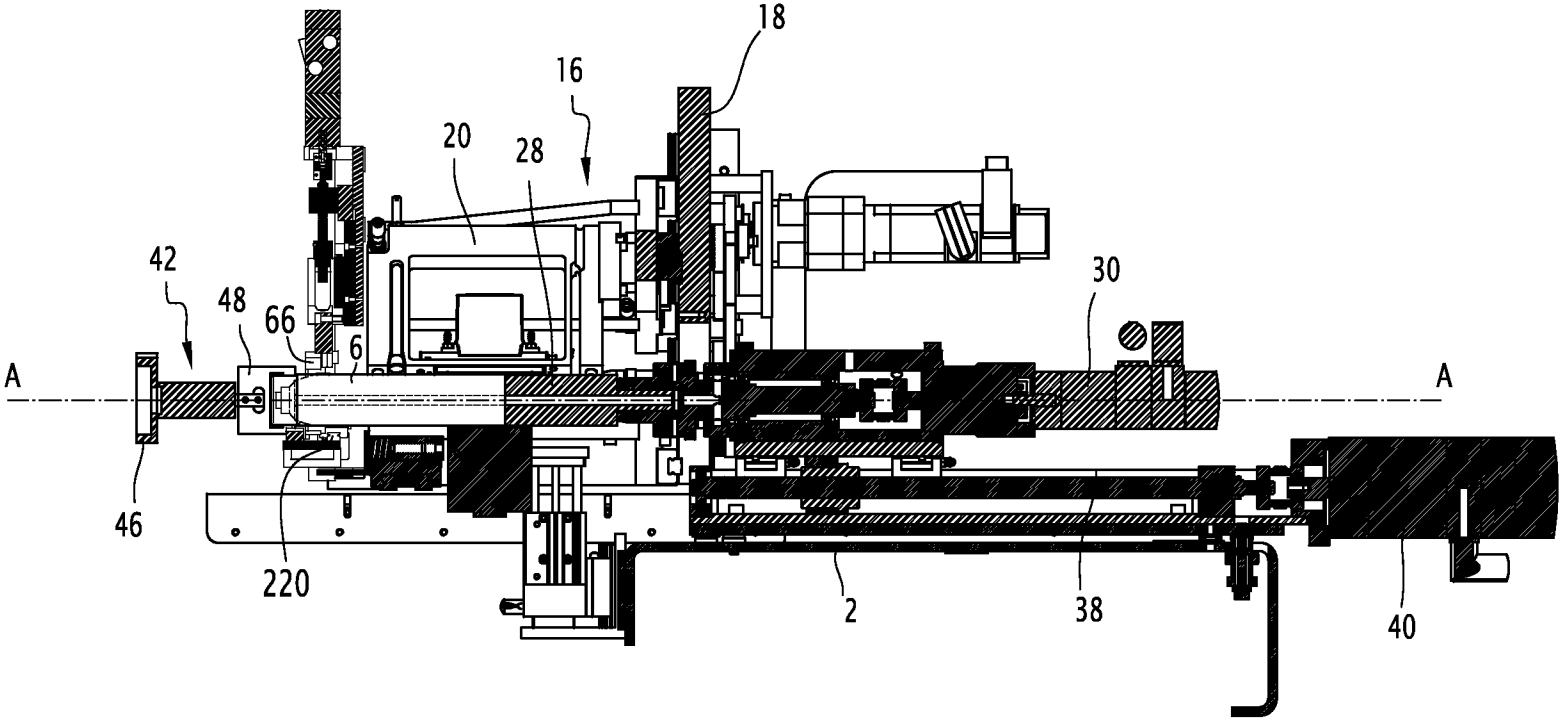
Figure 8:
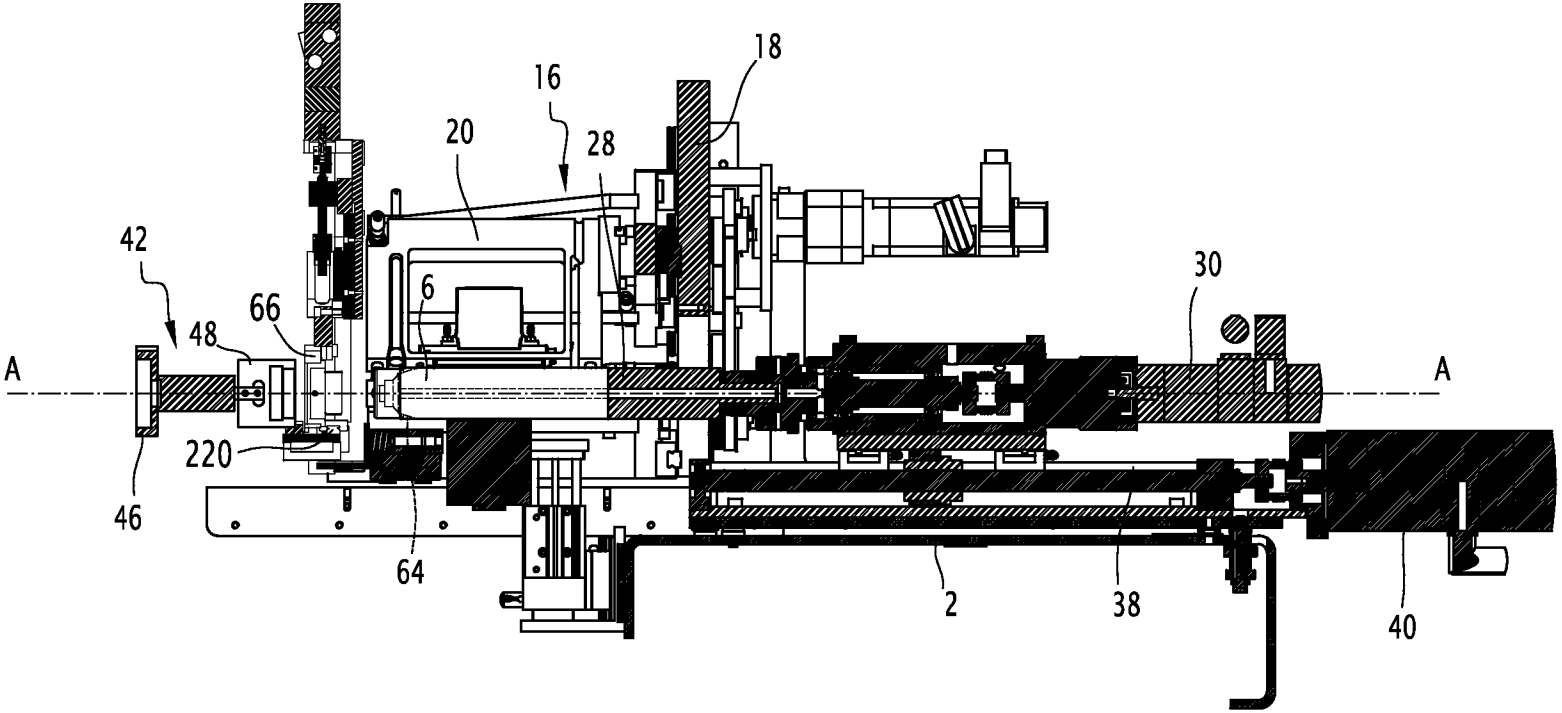
Figure 9:
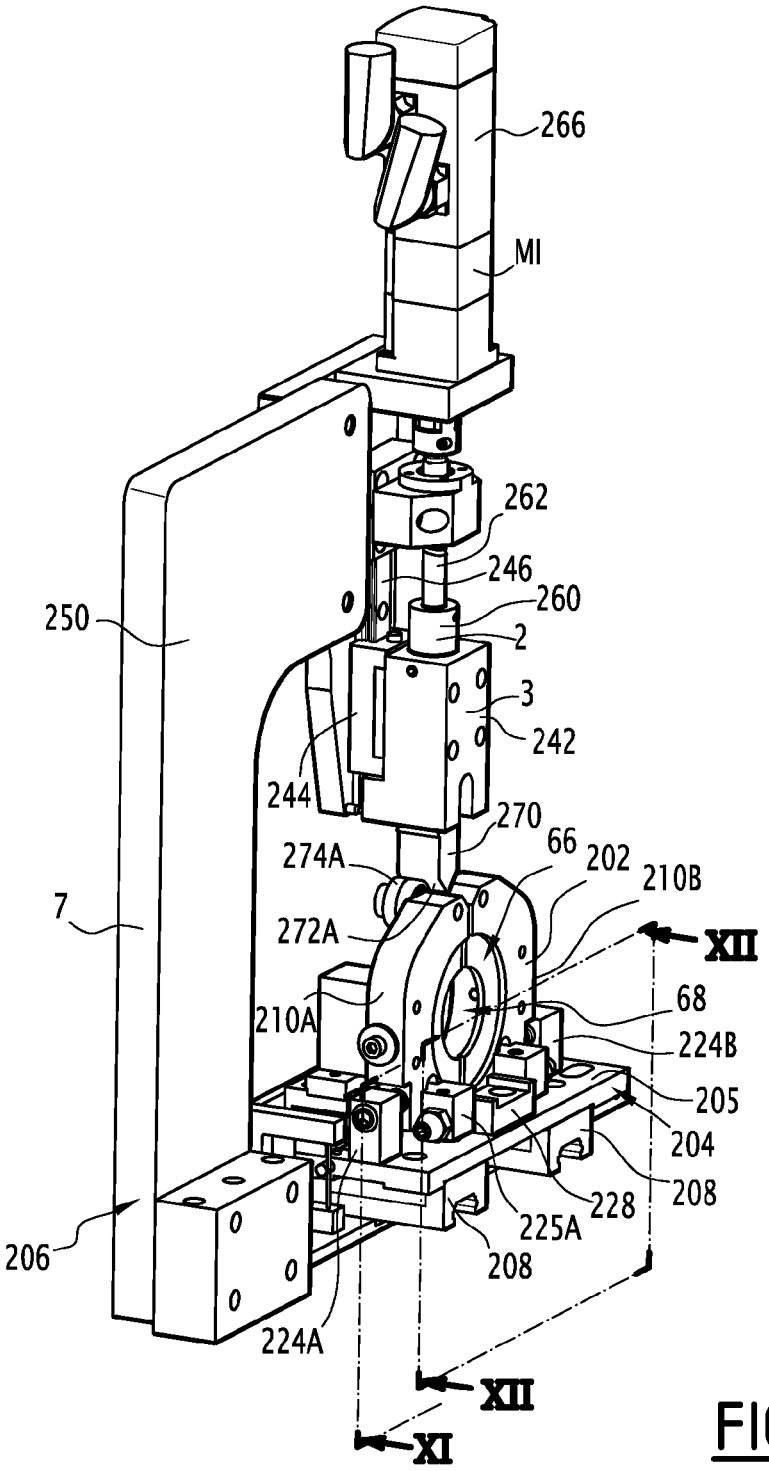
Figure 10:
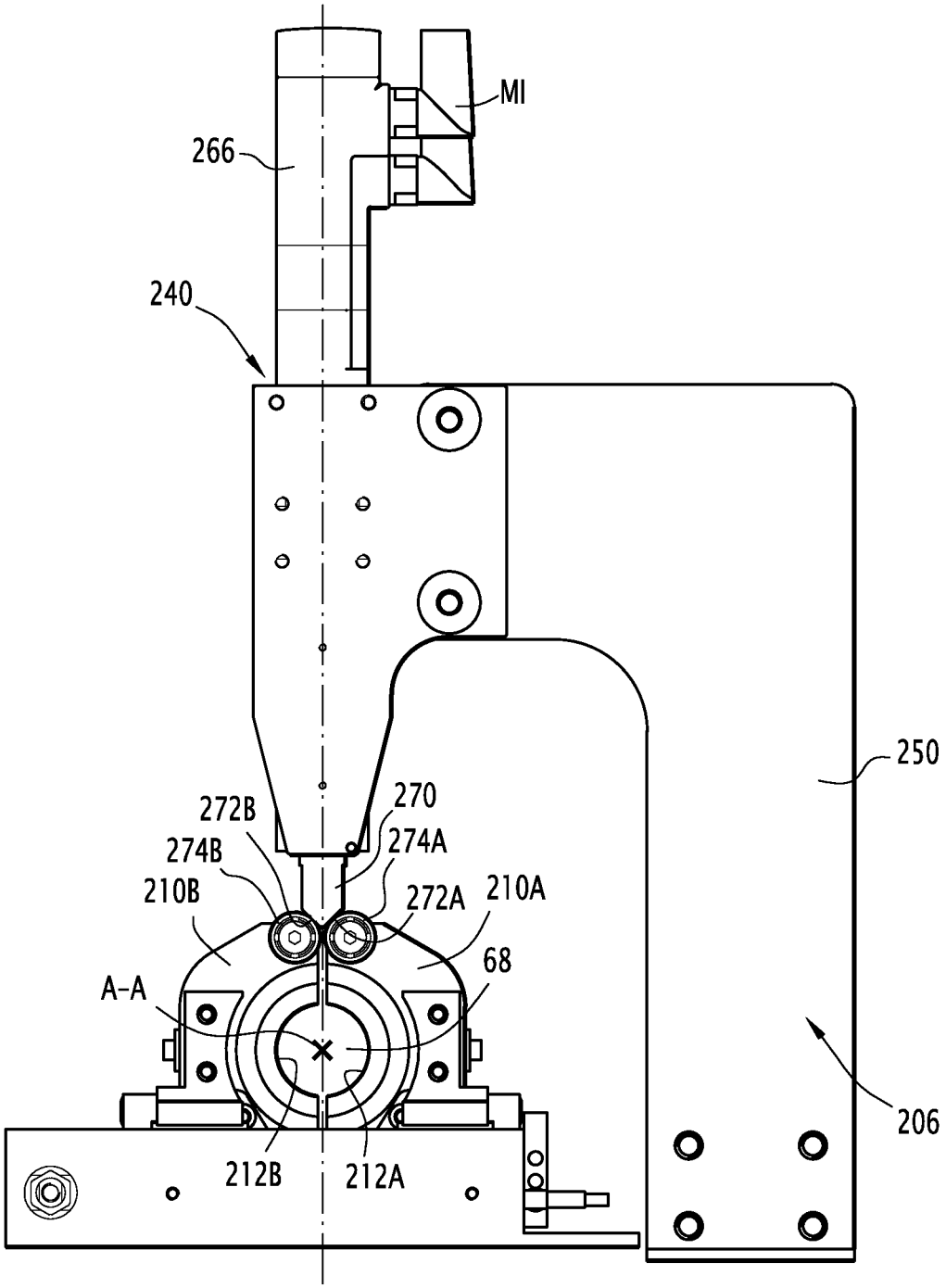
Figure 11:
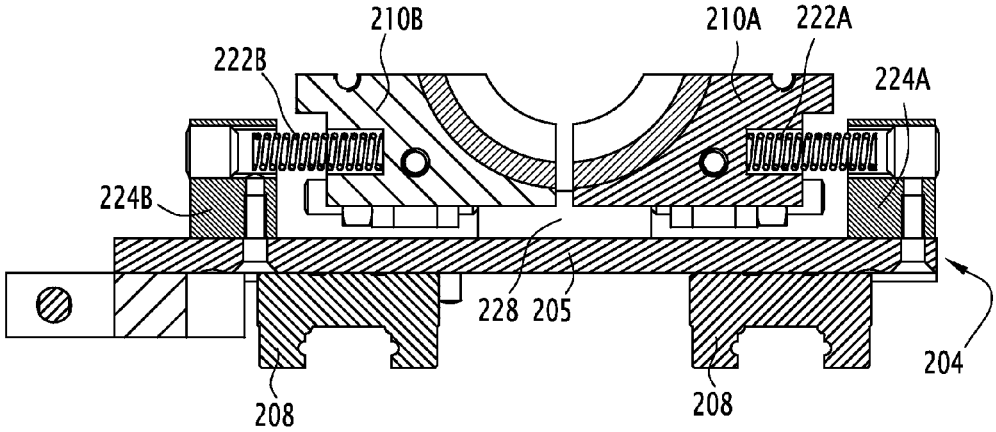
Figure 12:
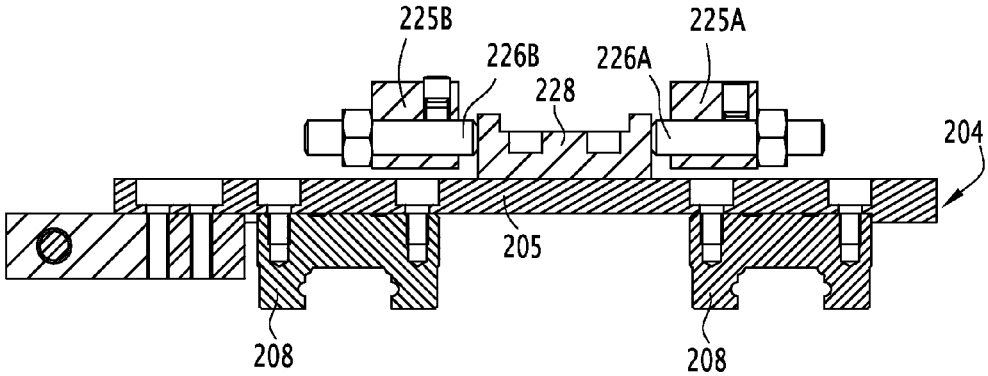
Figure 13:
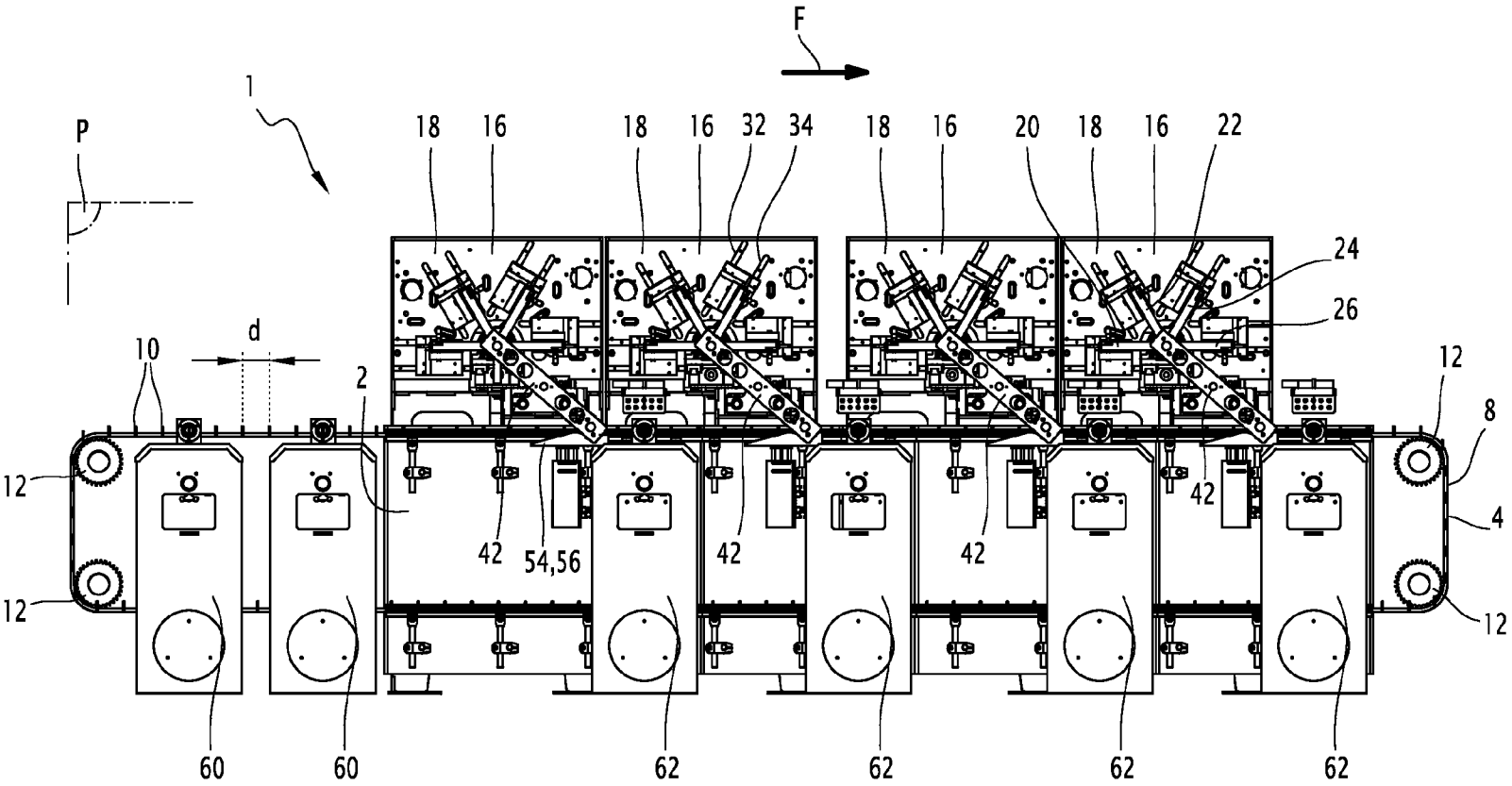

Other aspects and advantages of the invention will appear upon reading the following description, provided as an example and done in reference to the appended drawings, in which:

FIG. 1 is a diagrammatic perspective illustration of the printing machine according to one embodiment of the invention, the machine comprising a single printing station, FIG. 2 is a diagrammatic perspective illustration of the printing machine of FIG. 1 seen from another orientation, FIG. 3 is a diagrammatic side illustration of the printing machine of FIG. 1, FIGS. 4 and 5 are diagrammatic top illustrations of a core bearing an object to be printed and a printing unit, the object being placed in two different positions, FIGS. 6, 7 and 8 are diagrammatic cross-sectional illustrations of part of a printing station according to one embodiment of the invention during the loading of an object to be printed on the core (FIGS. 6 and 7) and the printing of that core (FIG. 8), the object being shown from above, FIG. 9 is a detailed perspective view of a calibration bezel of the machine of the preceding figures, FIG. 10 is a front view of the calibration bezel of FIG. 9, FIGS. 11 and 12 are partial cross-sectional views of the bezel of FIG. 9 taken along the planes XI-XI and XII-XII, respectively, and FIG. 13 is a diagrammatic front illustration of a printing machine comprising four printing stations.

The printing machine 1 according to the invention is shown in FIGS. 1 and 2. It comprises a housing 2 supporting transport means 4 for transporting objects 6 to be printed. The objects 6 to be printed substantially have shapes of revolution, such as tubes or substantially cylindrical containers.

The transport means 4 are formed by an endless conveyor 8, supporting multiple fingers 10 for receiving an object to be printed, separated from each other by a distance d defining the pitch of the transport means. The conveyor 8 is for example formed by a belt closed on itself, such as a transport chain, positioned around driving means 12, such as toothed wheels, arranged so that the conveyor has a substantially rectangular shape. The driving means 12 are rotatably mounted on the housing 2 and at least one of the driving means 12 is rotated by a motor (not shown), so as to cause the belt 8 to circulate in a plane of circulation P, in which the entire conveyor 8 extends, on the driving means 12. The branch 14 of the belt circulating on the upper driving means 12, called upper branch 14, is the part of the belt that bears the objects 6 to be printed and moves them between the different stations of the printing machine 1, as will be described later. The upper branch 14 extends substantially horizontally and moves in a substantially vertical plane. The plane P of circulation of the conveyor 8 is inclined relative to the vertical plane in which the upper branch circulates, as shown in FIG. 3. Such an incline makes it possible to continuously subject the objects 6 supported by the fingers 10 to a force that presses them against the fingers 10 so as to ensure good maintenance of the objects 6 on the fingers. In the figures, the arrow F shows the direction of travel of the upper branch 14 of the conveyor 8.

The fingers 10 are formed by thin rods long enough to receive the objects 6 and hold them freely. The fingers 10 extend from the conveyor 8 in a direction substantially perpendicular to the plane of circulation P of the conveyor 8 toward the outside of the housing 2.

The transport means 4 described above are for example known from document U.S. Pat. No. 7,540,232.

In a known manner, the objects 6 to be printed are positioned on the fingers 10 one after the other in a loading station (not shown) positioned upstream from the upper branch 14 relative to the direction of travel F. Also in a known manner, the printed objects 6 are withdrawn from the fingers 10 in an unloading station (not shown) positioned downstream from the upper branch 14 relative to the direction of travel F. The objects may loaded and unloaded done using any suitable means, known by those skilled in the art and not described in detail here.

The upper branch 14 circulates across from at least one printing station 16 positioned between the loading station and the unloading station.

The printing station 16 comprises a platen 18 fixed on the housing 2 and extending substantially in the plane of circulation of the upper branch 14, i.e., substantially vertically. According to the embodiment shown in the figures, the printing station comprises four printing units 20, 22, 24, 26 mounted next to one another on the platen 18 around a core 28 rotatably mounted on the housing 2, relative to the platen 18. The four printing units make it possible to print photographic images, since each unit is supplied with ink of a different color, i.e., the three primary colors (yellow, cyan and magenta) and black ink so as to form a multi-color printing. These inks therefore make it possible to print any type of image on the objects 6.

The core 28 is capable of supporting the objects 6 to be printed and has an axis of revolution A-A around which the core 28 is rotatable, driven by a motor 30 (FIG. 3) whereof the drive shaft is directly engaged with the axis of the core 28, i.e., the drive shaft of the motor 30 extends along the axis A-A. The speed of rotation of the core 28 is therefore constant and is easily adjustable, since it is equal to the speed of rotation of the drive shaft of the motor 30. The axis A-A of the core 28, substantially perpendicular to the plane of circulation of the upper branch 14 and therefore perpendicular to the platen 18, is stationary relative to the platen 18. In other words, the core 28 is not translatable in the vertical plane of circulation of the upper branch 14 of the conveyor 8 and the axis of rotation A-A of the core 28 is stationary relative to the printing station 16.

Advantageously, the core 28 is equipped with piercings formed in air intake nozzles emerging at the outer surface of the core. These nozzles are connected to a pressurized air source. This air source is controlled to supply air to the nozzles after printing and immediately before and during unloading of an object from the core, in order to facilitate the withdrawal of that object.

The printing units 20, 22, 24, 26 are inkjet devices comprising multiple nozzles arranged to spray ink on a printing area of the objects 6 to be printed in a known manner. Such printing units being known, they will not be described in detail here. One skilled in the art may for example refer to document EP-1,918,100.

The printing units 20, 22, 24, 26 are positioned on an arc of circle whereof the center is combined with the axis A-A of the core 28 such that the nozzles extend substantially parallel to the axis A-A of the core 28 and are located across from the area to be printed of the object 6 supported by the core 28, for example at a distance substantially comprised between 1 mm and 3 mm from the area to be printed. The platen 18 is provided with a pair of positioning rails 32, 34 per printing unit, said rails extending radially around the axis A-A of the core 28 so as to make it possible to adjust the distance of the printing units 20, 22, 24, 26 relative to the axis A-A. The printing units 20, 22, 24, 26 are each mounted on a pair of rails 32, 34, which makes it possible to adjust the position of the printing units 20, 22, 24, 26 based on the diameter of the objects 6 to be printed by moving the printing units on their respective rails 32, 34. The printing units 20, 22, 24, 26 can be moved on the rails 32, 34 using a single motor connected to the units by suitable means (not shown).

According to the embodiment shown in the figures, the printing units 20, 22, 24, 26 are positioned over a 180° range around the object 6 to be printed. In that range, the printing units 20, 22, 24, 26 are regularly distributed so as to form a 60° angle relative to one another.

It is, however, understood that the four printing units may be distributed over a range greater than 180° or that more than four printing units may be provided over a range greater than 180°. In fact, the axis of the core 28 being stationary relative to the printing station, it is not necessary to provide a release area making it possible to move the core 28 in the vertical plane of circulation of the upper branch 14. Thus, the printing station may be arranged so that printing or drying units surround the entire circumference of the core 28. This for example makes it possible to increase the printing rhythm by increasing the number of printing units positioned around the core 28.

According to one embodiment, the printing station 16 further comprises a surface drying unit 35 for the ink sprayed on the object 6 to be printed. This unit 35 is for example formed by one or more light-emitting diodes (LED) mounted on a holder arranged on the same arc of circle as the printing units and positioned across from the printing area of the object 6 to be printed. The drying unit is capable of freezing the ink printed on the object 6 fitted on the core 28.

One or two additional printing units (not shown) can also be provided on the same arc of circle as the other printing units so as to varnish the printing area after printing thereof using one of the additional printing units and/or so as to print a white background (for example, on a colored object 6) before printing the other colors making up the multi-color printing, using the other of the additional printing units.

The core 28 is further translatable along its axis A-A so as to make it possible to expose a wider printing area, or several printing areas, to the printing units 20, 22, 24, 26, as shown in FIGS. 4 and 5. Since the axis A-A of the core 28 is stationary relative to the platen 18, it is particularly simple to make the core 28 translatable. To that end, the assembly formed by the core 28 and its driving motor 30 is mounted on rails 38 (FIG. 3) extending substantially parallel to the axis A-A and the translational movement is actuated by a motor 40 connected to the core 28/motor 30 assembly by suitable means. Thus, objects 6 having a printing area with a height greater than the height of the printing units 20, 22, 24, 26 can be printed by translating the core 28 relative to those units, as shown by FIGS. 4 and 5, in which the core 28 adopts two different positions.

The inkjets of each printing unit 20, 22, 24, 26 are activated in synchronization with the rotation of the core 28. To that end, a control unit (not shown) is able to receive information on the speed of rotation of the core 28 and the position of the core 28 in translation, and is connected to each printing unit 20, 22, 24, 26 to control their activation. The control unit is further able to receive data representative of the pattern to be printed on the objects, and data representative of the diameter of the objects to be printed. The control unit is capable of commanding the activation of the spraying of ink from each printing unit 20, 22, 24, 26 based on the position of the core 28, and therefore the object positioned on the core 28, as well as the speed of rotation of the core 28 during printing. The control of the printing units is known in itself, and is for example described in document EP-1,918,100. It should, however, be noted that that control is simplified using the printing machine according to the present invention. In fact, the motor 30 being directly engaged with the axis of rotation of the core 28, there is no difference between the speed of rotation of the core 28 and that of the drive shaft of the motor 30. It is therefore not necessary to adapt the speed of rotation of the drive shaft of the motor 30 to obtain a constant peripheral speed of the core 28.

The printing machine 1 comprises transfer means 42 for transferring an object 6 to be printed from the transport means 4 to the printing station 16, i.e., from a finger 10 to the core 28. These transfer means 42 comprise a shaft 44 extending along an axis B-B that is substantially parallel to the axis A-A of the core 28 and translatable along that axis B-B (FIG. 3). The shaft 44 comprises, at its end opposite the housing 2, an arm 46 that is rotatable around the axis B-B and provided, at least at one of its ends, with gripping means 48 capable of gripping an object 6. The arm 46 is therefore rotatable in a plane substantially parallel to the vertical plane of circulation of the upper branch 14 of the conveyor 8 and can come closer to or further away from that plane by the translation of the shaft 44 along the axis B-B. The gripping means 48 are for example formed by a clamp, the jaws of which have a shape substantially complementary to the objects 6. Said jaws are movable between an open position, in which they can move around an object 6, and a closed position, in which they grip an object 6 without deforming it. The transfer means 42 are therefore capable of grasping an object 6 on a finger 10, by rotating the arm 46 so as to place the gripping means 48 across from an object 6 supported by a finger 10 and translating the shaft 44 so as to place the gripping means 48 in the open position around the object 6, then placing the gripping means in the closed position. The transfer means 42 are also capable of placing the grasped object 6 on the core 28, by translating the shaft 44 so as to cause the object 6 to leave the finger 10 and rotating the arm 46 so as to place the gripping means 48 bearing the object across from the core, then again translating the shaft 44 so as to bring the object 6 onto the core 28 and causing the gripping means 48 to switch to the open position so as to release the object 6 held by the core 28. It is understood that the transfer means 42 are also capable of withdrawing a printed object 6 from the core 28 and placing that object 6 on a finger 10, through opposite movements. The shaft 44 is translated by a motor 50, and the arm 46 is rotated by a motor 52 (FIG. 3).

As shown in FIGS. 6, 7 and 8, the free end part 64 of the core 28, across from the transfer means 42, is in the shape of a tapered cone of revolution, whereof the small base forms the free end of the core and the large base has a diameter equal to the diameter of the rest of the core 28. Such a shape of the free end part 64 of the core makes it possible to facilitate the loading of an object 6 on the core 28 while forming centering means for centering the object 6 on the core 28. In fact, the free end wall 64 of the core makes it possible to guide the object 6 on the core 28 if the gripping means 48 are not completely centered on the axis A-A of the core 28 during the loading of the object 6 on the core 28.

The translation of the core 28 along the axis A-A also makes it possible to facilitate the loading of an object 6 by making the core 28 movable between a loading position, shown in FIGS. 6 and 7, and a printing position, shown in FIG. 8. In the loading position, the core 28 is translated toward the gripping means 48, such that its end part 64 is separated from the printing units 20, 22, 24, 26, and in the printing position, the core 28 is brought back toward the platen 18 such that the end part 64 and the printing area of the object 6 extend across from the printing units 20, 22, 24, 26. The translational travel of the transfer means 42, allowing an object 6 to be loaded on the core 28, is thus reduced and the loading is made easier, since the end part 64 of the core 28 is located in a space freed when the core 28 is in the loading position, which limits the risk of the object 6 colliding with an element surrounding the core 28 during the movement of the transfer means 42.

According to the embodiment shown in the figures, the arm 46 bears a clamp at each of its ends and is rotatably mounted on the shaft 44 at its center. Thus, the transfer means 42 are able to grasp an object 6 to be printed on a finger 10 and, simultaneously, a printed object 6 on the core 28, and to deposit the object 6 to be printed on the core 28 and, simultaneously, the printed object 6 on the finger 10. Thus, through the same operations, a printed object is unloaded from the core 28, and that core is loaded with an object to be printed.

It is possible that some of the objects 6 may be deformed or damaged before they are printed, for example during storage. This deformation may cause a local increase in the diameter of the object relative to the nominal diameter of the objects to be printed, for example if said object has been crushed. The deformation may also cause "crumpling" of the object when it is inserted on the core 28, if the wall of the object 6 bears against the core, for example, which also increases the nominal diameter of the object 6. Such an increase in the diameter of the object 6 may irreversibly damage the nozzles of the printing units 20, 22, 24, 26, since the object 6 rubs against them when it rotates with the core 28. To prevent such a risk, the printing machine 1 is arranged to prevent a deformed object 6 from being loaded on the core 28.

To that end, the printing machine 1 comprises a calibration bezel 66 shown enlarged in FIGS. 9 and 10. This bezel is inserted between the transfer means 42 and the printing units 20, 22, 24, 26 on the axis A-A of rotation of the core 28. The bezel 66 is secured to the housing 2 and comprises a central opening 68 with a variable section delimited by a crown 202 formed by moving sectors.

The crown 202 inwardly has a reduced diameter when the moving sectors are tightened and a wider diameter when they are loose. The calibration bezel 66 is then in the tightened and loose position, respectively. When the crown is in the tightened position, as described later, the central opening 68 has an annular shape substantially complementary to that of the objects to be printed 6 and with an axis A-A. In other words, the central opening 68 is centered on the axis A-A between the core 28 and the gripping means 48 such that an object to be printed 6 must pass through the central opening 68 during loading thereof on the core 28 by the transfer means 42.

In the tightened position of the bezel, the central opening 68 has a diameter larger than that of the core 28, but smaller than the sum of the nominal outer diameter of an object 6 mounted on the core and 1.5 mm. In other words, when the object 6 indeed has a constant nominal outer diameter, play exists substantially equal to one times the thickness of the wall of an object 6 between the edge of the central opening 68 and the object to be printed 6 when said object passes through the calibration bezel 66.

The bezel 66 is mounted on the housing 2 by means of a slide, which makes it translatable along an axis parallel to the axis A-A relative to the housing 2.

To that end, the crown 202 is supported by moving equipment 204, whereof a platen 205 is movable relative to a chassis 206 rigidly fixed to the housing of the machine.

The moving equipment is guided in translation relative to the housing 206 by means of two slides 208, ensuring a translational movement along the axis A-A of the crown 202.

The moving equipment is biased by elastic means toward an idle position separated from the core 28 and is movable toward the core 28 against the action of the elastic means under the action of the contact of an object introduced along the axis A-A on the core 28 whereof the diameter is larger than that of the central opening.

A contactor is inserted between the moving equipment 204 and the chassis 206 to detect the translational movement and command the stop of the loading of the machine with the considered object.

The crown 202 includes two flanges 210A, 210B each delimiting a cavity in the shape of a half-circle 212A, 212B constituting a sector of the crown. These flanges are mounted sliding in a same plane relative to the platen 205 of the moving equipment 204. This platen extends perpendicular to the axis A-A of insertion of the tube.

The two flanges are each mounted on a guideway 220 visible in FIG. 6. As illustrated in FIG. 11, the two flanges are biased toward each other by means of springs 222A, 222B inserted between the flanges and a stop stud 224A, 224B secured to the platen 205 of the moving equipment 204.

Stops 226A, 226B, shown in FIG. 12, are provided on each of the flanges 210A, 210B to immobilize the two flanges in position pushed back under the action of springs 222A, 222B. The stops 226A, 226B can cooperate with a median tab 228 secured to the platen 205.

When the two flanges are thus in their position defined by the stops 226A, 226B bearing on the tab, the bezel is in the tightened position.

An actuator 240 is provided to move the two flanges 210A, 210B between the tightened position, in which the central opening 68 is small, and a loose position, in which the central opening 68 is large.

In the embodiment illustrated in FIG. 9, the actuator 240 includes a slide 242 mounted slidingly movable relative to the chassis 206 by means of a ball tab 244 mounted on a guideway 246 provided at the end of a cantilever arm 250 of the chassis 206. The slide 242 is translatable along the guideway 246 under the action of a screw-nut arrangement, a nut 260 being secured to the slide and engaged around a screw 262 positioned along the direction of movement of the slide. The screw is driven by an electric motor 266 mounted at the head of the cantilever arm 250.

At its end, the slide 242 is equipped with a corner 270 having two converging cam surfaces 272A, 272B capable of cooperating with rollers 274A, 274B provided at the upper ends of the flanges 210A, 210B.

The control of the motor 266 is subjugated to the control of the machine, such that the bezel 68 switches between its tightened position and its loose position based on the loading and unloading phases of an object 6 on the core 28.

Thus, the motor 266 is controlled so as to bring the bezel 68 into its tightened position before loading an object on the core 6 from the transfer means. To that end, the corner 270 is separated from the rollers 274A, 274B, thereby releasing the two flanges 210A, 210B, which are pushed back under the action of the springs 222A, 222B toward one another and bear on the tab 228 by means of the stops 226A, 226B.

However, when an object must be withdrawn from the core 28 after printing, the motor 226 is commanded to bring the bezel into its loose position in which the two flanges 210A, 210B are separated from each other against the action of springs 22A, 22B.

To that end, the motor 226 moves the corner 270 toward the axis A-A. The rollers bearing on the cam surfaces 272A, 272B cause the two flanges to be translated against the springs 222A, 222B.

The position of the stops 226A, 226B, the shape of the cams 272A, 272B, as well as the shape of the cavities delimited by the flanges 210A, 210B are adopted such that in the tightened position of the bezel, the diameter of the central opening 68, i.e., the maximum distance separating the cavities, is substantially equal to the nominal outer diameter of the tube increased by one times the distance separating the or each printing unit from the outer surface of the tube during printing. This distance is comprised between 0.6 and 1 mm, and is often equal to 0.8 mm. In the loose position, the diameter of the central opening is at least 4 mm larger relative to the nominal diameter of the object to be printed.

One can see that with such an arrangement, during the loading of an object to be printed on the core 28, the bezel is in the tightened position and then defines a small opening.

The position of the calibration bezel 66 relative to the housing 2 is such that the central opening 68 extends around the end part 64 of the core 28 when the latter is in the loading position, as shown in FIGS. 6 and 7. The bezel 66 therefore extends upstream from the printing units 20, 22, 24, 26 relative to the direction of loading of an object 6 on the core 28. During the loading of an object 6 on the core, the calibration bezel 66 is in the tightened position. The object 6 is already engaged on the core 28 and centered by its end part 64 when it passes through the central opening 68 of the calibration bezel 66, which improves the guiding of the object 6 toward that opening 68 and facilitates its passage through the opening 68 despite the small play between the object 6 and the edge of the opening 68.

It will be understood that if the object to be printed 6 is deformed and has a diameter larger than the nominal diameter that it should have, it cannot pass through the central opening 68 of the calibration bezel 66 when the bezel 66 is in the tightened position. In that case, the object 6 is stopped by the edge of the central opening 68. Thus, if a deformed object 6 collides with the bezel 66, the latter moves in translation toward the housing and actuates the contactor arranged to stop the motor 50 actuating the translation of the transfer means 42. Thus, the loading of the deformed object 6 is stopped immediately and the object 6 cannot damage the nozzles of the printing units 20, 22, 24, 26, since the bezel 66 extends upstream from the latter relative to the loading direction of the object 6 and since the diameter of its central opening 68 is smaller than the sum of the diameter of the object 6 and 0.75 mm, knowing that the distance between the lower edge of the nozzle and the object 6 with the nominal diameter is approximately 0.8 mm, i.e., a space of at least 0.1 mm exists between an object 6 passed through the bezel 66 and the nozzles of the printing units 20, 22, 24, 26. The bezel 66 therefore makes it possible to ensure that only objects 6 having the required shape and diameter will be printed by the printing station 16.

Advantageously, the two flanges are separated once the central opening 68 is crossed by the front end of the object, preventing any subsequent contact between the object and the bezel and favoring the engagement of the object on the core, in particular if a flow of air is blown from the nozzles of the core to favor the sliding of the object on the core, since in that case, the object risks undergoing a radial deformation.

During the unloading of an object, the two flanges are separated under the action of the motor 226 such that the calibration bezel 66 is brought into its loose position and then has a larger central opening 68. The printed object can then be transferred through the bezel without any risk of colliding therewith, even if under the action of the air leaving the nozzles formed on the surface of the core, the diameter of the object may have increased slightly. The separation of the two flanges from the bezel prevents any inopportune contact between the bezel and the object being transferred.

The objects 6 being placed freely on the fingers 10, they should be positioned around the fingers 10, relative to the gripping means 48 of the transfer device 42. To that end, the printing machine 1 comprises means 54 for locking the position of an object 6 around a receiving finger 10 that are positioned across from the transfer means 44. These locking means 54 are formed by a locking element 56 provided with at least one locking surface 58 and mounted translatably in the vertical plane relative to the housing 2 between a locking position and a retracted position. In the locking position, the locking surface 58 is pressed against an object 6 supported by a finger 10 across from the transfer means 44 so as to immobilize that object around the finger 10, and in the retracted position, the locking element 58 is separated from the conveyor 8. It should be noted that in the locking position, the object 6 is no longer in contact with the finger 10, the object 6 being lifted from that finger by the locking surface 58.

The locking surface 58 is arranged not to deteriorate the printing area of the object 6, which could create defects in the printing of the object. To that end, the locking surface 58 for example has a shape substantially complementary to a part of the object 6 to be printed and is covered with a fabric or another protective material or has received a specific surface treatment to avoid damaging the printing area of the object. According to another embodiment, the locking element 56 comprises one or more locking surfaces arranged to be pressed against the object 6 outside the area to be printed, for example above and/or below that area to be printed.

In order to ensure the locking of the position of the object 6 around the finger 10, the locking means 54 further comprise suction means (not shown) for suctioning the object 6 supported by the receiving finger, such suction means being arranged to immobilize said object 6 on the locking surface 58 in the locking position.

The locking means 54 are placed in the retracted position after the withdrawal of an object 6 to be printed on the finger 10 so as not to come into contact with a printed object 6 that will be placed on the finger 10 and thus avoid damaging the printed area of that object 6. In fact, as previously described, a printed object 6 is placed on the receiving finger 10 from which an object to be printed was removed during the transfer of that object to be printed from the finger 10 to the core 28.

A pretreatment station 60 for pretreating the surface of the object 6 to be printed is provided upstream from the printing station 16, between the loading station and the printing station 16 across from the fingers 10. This pretreatment station 60 is arranged to treat the area to be printed of the objects 6 before they are printed. This treatment aims to allow better adhesion of the ink on the area to be printed.

Furthermore, a drying station 62 for drying the surface of the printed object 6 is provided downstream from the printing station 16, between the printing station 16 and the unloading station across from the fingers 10. This station is for example formed by core polymerization means of the printing so as to definitively freeze the ink on the surface of the printed objects.

The printing machine described above comprises a single printing station 16. To increase the printing rhythm, it is possible to add more printing stations. Thus, according to one embodiment that is not shown, the printing machine comprises two printing stations 16 positioned next to one another and according to the embodiment shown in FIG. 6, the printing machine 1 comprises four printing stations 16 positioned next to each other. Each printing station 16 comprises its own corresponding unique core 28 on which the printing units of said printing station only print the objects supported by the core 28. Each printing station 16 also has corresponding transfer means 42, locking means 54 and a drying station 62. A pretreatment station 60 for pretreating the surface is suitable for operating with two printing stations 16. Thus, according to the embodiment shown in FIG. 6, the printing machine 1 comprises two pretreatment stations 60 for four printing stations 16.

The operation of the printing machine 1 and the method for printing objects will now be described.

The objects to be printed 6 are first loaded on the conveyor 8 at the loading station, the objects being positioned one after the other on the adjacent receiving fingers 10. The objects 6 then circulate on the upper branch 14 and advance along the direction F and pass in front of the pretreatment station 60, where they undergo a surface treatment for their later printing.

According to the embodiment in which the printing machine comprises a single printing station, when an object 6 to be printed arrives across from the transfer means 42, the printing machine stops. The locking means 54 go into the locking position and the core 28 goes into the loading position. The transfer means 42 withdraw the object 6 from the conveyor and place it on the core 28 by passing through the calibration bezel 66. The core 28 next returns to its printing position. If a printed object was positioned on the core 28, that object is removed at the same time and is placed on the finger that was just freed. The locking means 54 then go into the retracted position during the transfer of the objects so as not come into contact with the printed object. The conveyor 8 starts to circulate again so as to bring the following finger across from the transfer means 42 and restart the transfer described above.

If a deformed object is withdrawn from the conveyor, it collides with the bezel 66 when the transfer means 42 place it on the core 28, which causes the movement of the transfer means to stop. An operator can then remove the defective object 6 and restart the printing machine, the transfer means withdrawing the following object on the conveyor.

The object 6 placed on the core 28 is printed by exposing it to the jets of ink from the different printing units 20, 22, 24, 26. The printing units are activated in a manner synchronized with the rotation of the core 28, in a known manner using the control unit based on the speed of rotation of the core 28, the position of the object on the core, the pattern to be printed and the diameter of the object to be printed.

If the area to be printed is larger than the height of the printing units, the core 28 is translated during the printing process so that the entire printing area is printed. To that end, the printing process comprises rotating the core 28 so as to print a first printing area across from the printing units (FIG. 4), translating the core 28 so as to place a second printing area across from the printing units (FIG. 5), then printing the second printing area.

In addition to the printing of the four colors making up the multi-color printing, the object optionally undergoes varnishing and/or printing of a white background (for example, for colored objects) and/or partial drying if the corresponding units are active on the printing station. It should be noted that the printing rhythm is very high, due to the number of printing units, the simplicity of adjusting the printing station 16 with a single core, and the printing being done very precisely, since the axis A-A of the core 18 is stationary and the position of the object 6 therefore does not vary and is known at all times. It will in particular be noted that, since the axis of the core is stationary, it is easy to add a printing unit around the core 28, by distributing the printing units over a range greater than 180°, to add other possibilities such as varnishing and/or printing a white background and/or to increase the printing rhythm.

When the printing machine 1 comprises two printing stations 16, the machine advances by two pitches, i.e., two times the distance d separating two fingers, before stopping so that an object is located across from the transfer means 42 of the two printing stations 16. The machine 1 stops and the objects are transferred. During the printing of this object, the printing machine advances again by two pitches, so as to place two new objects across from the transfer means 42. This is referred to as two-pitch indexing of the conveyor 8. When the printing machine 1 comprises two printing stations 16, the pitch, i.e., the distance d, is for example substantially equal to 150 mm (6 inches).

When the printing machine 1 comprises four printing stations 16, as shown in FIG. 13, the printing machine 1 indexes two pitches two times during the printing cycle of an object, each printing station 16 printing an object over four passes across from its transfer means 42. When the printing machine 1 comprises four printing stations 16, the pitch is for example substantially equal to 75 mm (3 inches). For a machine 1 with four printing stations, during a printing cycle, the stations print four objects simultaneously. The indexing is still done with two pitches and there are two indexing operations (i.e., two stops of the conveyor 8) per printing cycle, such that the first two printing stations relative to the direction F print the objects borne by every other finger (even fingers), i.e., an object situated between two even fingers is left on its finger (odd finger), and the last two printing stations print the objects borne by the odd fingers. This thereby procures an optimized operation of the machine with four printing stations.

The printing rhythm can thus easily be increased by simply adding printing stations along the conveyor 8, the architecture of this printing machine being simple enough not to complicate the assembly of the stations excessively. Such a rhythm could not be increased as simply in the prior art, due to the transport mode of the objects to be printed on multiple cores mounted on a rotating plate.

At the output of the printing station, the printed objects pass across from the drying station 62, where said objects undergo core polymerization to definitively freeze the printing.

The objects are next unloaded at the unloading station.

The machine described above therefore makes it possible to obtain very precise printing with a high resolution without requiring a complex adjustment of the printing station 16. In fact, after an initial calibration for the activation of the inkjets synchronized with the rotation of the core 28, it is no longer necessary to perform other adjustments of the printing station during printing operations, as long as the objects to be printed are identical to each other. In addition, the printing rhythm may easily be increased.

Furthermore, the machine makes it possible to protect the printing units from a defective object that could damage them by rubbing against the inkjet nozzles owing to the calibration bezel.

The invention claimed is:

1. A printing machine for objects with shapes substantially of revolution, said machine comprising:

means for transporting objects to be printed between at least one loading station for loading the objects on said transport means and an unloading station for unloading said objects from said transport means, at least one printing station positioned between the loading station and the unloading station, said printing station comprising at least one printing unit arranged to spray ink on the objects to be printed so as to print said objects, the or each printing unit projecting ink of a different color so as to form a color print, the printing station comprising a corresponding core for holding an object to be printed, said corresponding core being rotatable around its axis such that the or each printing unit projects ink on the object held by said corresponding core, means for transferring an object to be printed from the transport means to the printing station and from the printing station to transport means, and a calibration bezel comprising a central opening coaxial to the axis of rotation of the core, said bezel being arranged between the transfer means and the printing units such that an object to be printed passes through the central opening before being printed by the printing station, wherein the calibration bezel includes movable elements that can be moved between a tightened position of the bezel in which the central opening is small, and a loose position of the bezel in which the central opening is large, said movable elements being in the shape of crown sectors forming a crown in the tightened position, said crown delimiting an annular shape of the central opening, said crown sectors being translatable relative to one another along at least one radius of a circle delimited by the central opening, and wherein the calibration bezel includes means for moving the movable elements between the tightened and loose positions so that, when an object is transferred, by the transfer means, from the transport means to the printing station, the calibration bezel is in the tightened position at least until the central opening is crossed by one end of the object, and is afterwards in the loose position.

2. The printing machine according to claim 1, wherein the diameter of the central opening in the tightened position of the calibration bezel is larger than the diameter of the core and arranged so that there is a space of at least 0.1 mm between object passed through the central opening of the bezel and the or each printing unit when the calibration bezel is in the tightened position.

3. The printing machine according to claim 1, wherein the bezel is movable and arranged to actuate a contactor, arranged to stop the transfer means when it is actuated, if an object to be printed having a diameter larger than the diameter of the central opening, withdrawn by the transfer means, moves said bezel.

4. The printing machine according to claim 1, wherein the core is translatable along its axis between a printing position, in which the free end part of the core is located across from the printing units, and a loading position, in which the central opening of the bezel surrounds the free end part of the core.

5. The printing machine according to claim 1, wherein the transfer means comprise at least one moving arm supporting gripping means for gripping an object to be printed, said arms and said gripping means being arranged to withdraw an object from the transport means and deposit said object on the core and to withdraw the printed object from said core and deposit that printed object on the transport means through the calibration bezel.

6. The printing machine according to claim 1, wherein in the tightened position of the calibration bezel, the diameter of the central opening is substantially equal to the outer diameter of the object increased by one times the distance separating the or each printing unit from the outer surface of the object.

7. The printing machine according to claim 1, wherein the means for moving the movable elements include a motor and a slide moved by the motor, said slide including at least one cam surface capable of cooperating with at least one complementary cam surface provided on at least one moving element to move the moving element in at least one direction under the action of the movement of the slide.

8. The printing machine according to claim 1, wherein the movable elements include two crown sectors, each crown sector delimiting a cavity in the shape of a half-circle, said crown sectors being translatable relative to one another.

9. The printing machine according to claim 1, wherein the means for moving the movable elements include at least one elastic return means for returning the or each movable element toward one of the tightened and loose positions.

* * * * *